United States Patent [19]

Wessa

[11] 4,184,339

[45] Jan. 22, 1980

[54] PROCESS AND APPARATUS FOR THE MANUFACTURE OF CLEAR ICE BODIES

[76] Inventor: Theo Wessa, Siedlung 19, 6751 Mackenbach, Pfalz, Fed. Rep. of Germany

[21] Appl. No.: 843,857

[22] Filed: Oct. 20, 1977

[30] Foreign Application Priority Data

Oct. 21, 1976 [DE] Fed. Rep. of Germany ..... 2647541

[51] Int. Cl.[2] ..... F25C 1/20

[52] U.S. Cl. ..... 62/68; 62/342

[58] Field of Search ..... 62/68, 342, 73, 352

[56] References Cited

U.S. PATENT DOCUMENTS

| | | | |
|---|---|---|---|
| 1,392,385 | 10/1921 | Wishart | 62/68 |
| 2,028,806 | 1/1936 | Rechtin | 62/68 |
| 2,240,769 | 5/1941 | Glazer | 62/342 X |
| 2,606,427 | 8/1952 | Kirkpatrick | 62/68 |
| 2,969,650 | 1/1961 | Eschenberg et al. | 62/342 X |
| 3,027,731 | 4/1962 | Lindenberg et al. | 62/342 X |
| 3,162,020 | 12/1964 | Beckmann | 62/68 X |

*Primary Examiner*—Alfred C. Perham

*Attorney, Agent, or Firm*—Orville N. Greene; Frank L. Durr

[57] ABSTRACT

In a system for producing clear ice bodies by dipping freezing fingers into a tank of water and causing the water to move about the fingers as ice builds up thereon in order to remove air and salt from the ice bodies, the amount of water required per unit weight of ice obtained (since the water remaining from each batch is ordinarily discharged on removal of the frozen fingers containing the ice bodies) is decreased by maintaining the fingers stationary and producing the water movement by moving the tank so as to produce tank-wall to tank-wall waves. The top portions of the freezing fingers are covered by the water only during the crest of the waves.

10 Claims, 7 Drawing Figures

PROCESS AND APPARATUS FOR THE MANUFACTURE OF CLEAR ICE BODIES

The invention relates to a process and an apparatus for the manufacture of clear-ice bodies.

It is known to manufacture clear-ice bodies in small pieces in the so-called paddle system, in the course of which round or more angular freezing fingers are dipped in a stationary tank filled with water. The ice grows around the outside of these freezing fingers. In each row rotating paddle wheels, called paddles, are arranged so that the water is kept in motion until the ice bodies have grown so large that the motion of the paddles is checked and, in that way, the thawing step and the loosening of the finished ice bodies is started. The ice bodies go in a storage bin while the remaining residual unfrozen water must be drained off for hygienic reasons. The whole process will be called a freezing period.

The surrounding paddles produce a chaotic water movement and a rough water surface, which is for the purpose of separating air and salt, so as to obtain clear ice. The water movement is uncontrolled and distributed at different strengths over the total mass of the water. Direcly on that ice boundary layer which lies nearest to the paddles, the water movement is stronger than on the surfaces of those which are a greater distance from the paddles and which lie at an angle to the paddles. Thereby, it is difficult to attain a uniformity in clarity as well as in the shape of the ice bodies. Beyond that, the size of the ice bodies is determined by the dipping depth of the freezing fingers in the water and through the arrangement of paddles among the rows of freezing fingers. The paddle size, in turn, determines the spacing of the rows of freezing fingers. The transformation of inserted water into small ice bodies per freezing period is quantitatively inferior and it must be accepted with a very large loss of water. Through the relative value of the amount of water per produced unit of weight of ice per freezing period, a greater amount of useless energy is expended for cooling and the freezing process is lengthened per unit of time.

For the production of stick ice it is furthermore known, to attain water agitation by oscillating movement of the freezer cell about the middle point, whereby the freezer cell itself does a pendulum-like movement and water existing therein is displaced in a vibrating movement from the top surface to the bottom oppositely to the freezer cell. Here, likewise, only a disorderly, uncontrollable water agitation is obtainable. In the vicinity of the axis of rotation there is no water agitation, in comparison with regions spaced from the axis of rotation where the greatest vibration is established. A transparent clarity is therefore not attainable over the total ice mass, and besides, the arrangement is not suited for the production of small ice pieces.

It is also known to obtain an up and down movement of water, in a subdivided tank in which the water is drawn off or admitted to the individual regions through a pumping system or through the removable intermediate wall, changing the volume as the region is varied.

The problem of the invention consists in this, to make it feasible to attain, in as simple a way as possible, a water movement which is brisk, uniform and controlled, about the freezer fingers, with the least amount of water supply, for the production of small ice pieces with a crystal clear transparency. Further, the energy expended, the amount of water per freezing period and per unit weight of produced edible clear ice bodies must be decreased and the bodies themselves must have a uniform shape which produce the best cooling effect with the greatest surface.

The problem stated is solved through a process for manufacturing clear ice bodies by which the stationary freezer fingers are dipped in a water filled tank and the water is caused to circumcirculate the freezer fingers in a controlled rhythmic rise and fall movement of the water level, whereby this rise and fall movement takes place in the form of continuous water waves.

Such a continuous water wave can advantageously be defined as to and fro water waves from tank wall to tank wall.

It has been unexpectedly shown that the stationary frozen fingers do not break down the to and fro water waves. The waves with their wave crests and wave valleys wet the freezer fingers continuously in their total levels intensively and uniformly. Therefore, an essentially lower water level is necessary as compared to the known system since the circumcirculation height of the freezer fingers is determined by the height of the wave crests.

A rising and falling of the water level can also be attained by up and down movement of the tank. By raising the tank the always deeper dipping freezer fingers displace the water, so that the water level is also lifted in the form of a displacement wave. By lowering the tank, the reverse takes place, a sinking of the water level so that here also an intensive vertical circumcirculation of the freezer fingers in a corresponding rhythmic way results.

It does not matter how the continuous water waves are produced, and the vertical wave movement can be replaced by a horizontal wave movement.

For the production of the from tank-wall to tank-wall to and fro water waves, the tank can be connected with a crank gear which imparts a to and fro movement to the tank. These tank movements produce simultaneously aside from the wave, an approximately horizontal to and from water flow. Thereby an optimal circumcirculation of the freezer fingers or of the growing ice bodies is produced in the vertical as well as in the horizontal direction. If changing the depth of dipping of the freezer fingers in the water in the tank produces displacement waves, these can be superimposed by a horizontal water movement which is brought about by a pivoting of the tank around its vertical middle axis.

In place of the crank drive for the tank, an eccentric drive can also be provided with which the tank will be subjected to a tilting-like movement, around an approximate central pivoting point.

In order to obtain water waves of sufficient height and constant uniformity, the water level height in the tank, the tank length in the direction of flow of the water, the length of stroke of the horizontal or the tilting movement of the tank and the number of strokes per minute, are synchronized with one another. An optimal working is given when for the individual factors, the following sizes, for example, are installed.

Tank length in direction of water movement 400 mm
water level height in repose 13 mm
Length of stroke 36 mm
Number of strokes 42/min.

By observance of these values, an optimal height difference between the height of the wave crests and the height of the wave valleys and therewith an optimal circulation around the freezing fingers, is obtained.

Processes and apparatus according to the invention require essentially smaller amounts of water per freezing period than the known system. Also, the water loss is reduced since the utilization of the added water, in proportion to the amount of ice produced, is multiply more favorable. The energy utilization is better since with the smaller amount of water, the required low temperatures are reached quicker and thus shorten the freezing period. Through the elimination of the usual stirring apparatus, e.g., the paddles, the number of freezing fingers can be doubled, whereby a further useful advantage is obtained. The total development of the ice machine is simple and, in proportion to the amount of ice produced, smaller than in the known system. By the intensive circulation around the freezing fingers, the transparency of the ice is crystal clear.

The invention will now be further explained with the aid of the embodiments shown in the drawings wherein the figures are schematic and shown by way of example. In the drawing.

FIGS. *6a–e* shows a progression of wave crests and wave valleys in five time segments according to the invention.

Figure 7:
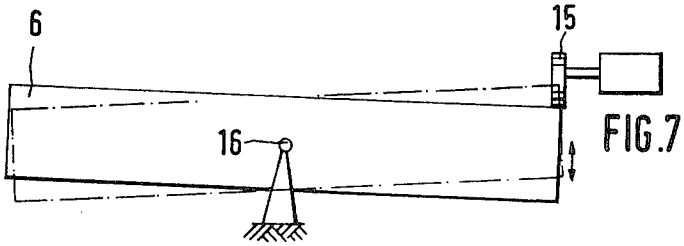

FIG. 7 shows an arrangement for the production of a tilting movement of the tank according to the invention.

By the known paddle system, the tank 1 and the freezer fingers 2 on the freezing vaporizer tube 3 are stationary. The water movement or agitation in the tank 1 is attained through rotation of the paddle wheels 4 which are always arranged between two adjacent series of freezing fingers in order for the ice body 5 to build up on the freezing fingers 2.

According to the invention, the tank 6 is given a horizontal to and fro movement by means of a crank drive 9. The stationary freezer fingers 7 positioned on the freezing vaporizer tube 8 can be placed in an optimal (only narrowly spaced) way under maximal place utilization. The dipping depth of the freezing fingers for the water at rest in the tank is dependent on the attainable height of the wave crests 11 and lies far below the attained height of the water circulating around the freezing fingers.

Figure 1:
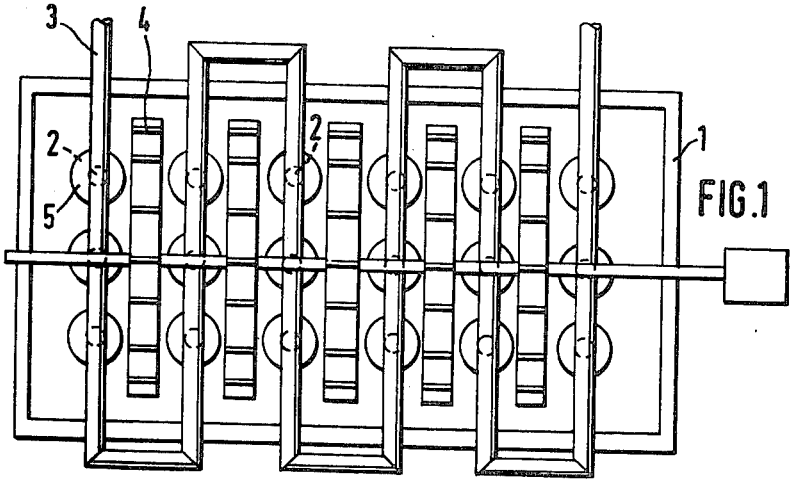
FIG. 1 is a top plan view of the known paddle system.
Figure 2:
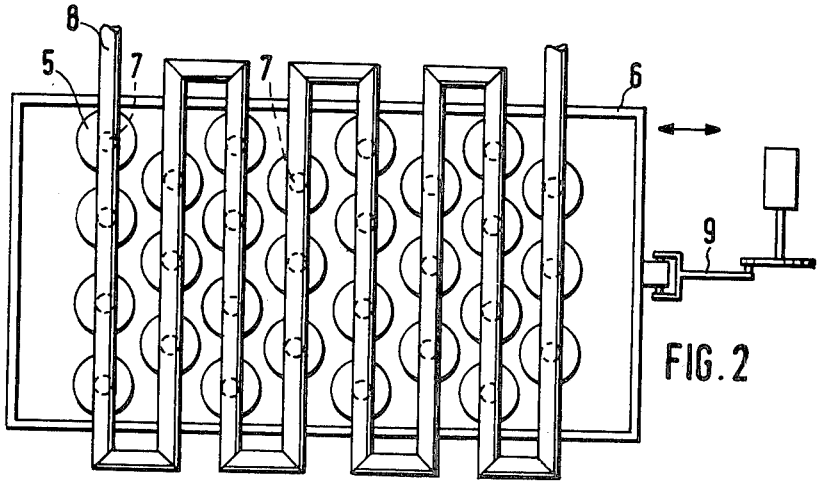
FIG. 2 is a top plan view of an apparatus made according to the invention.
Figure 3:
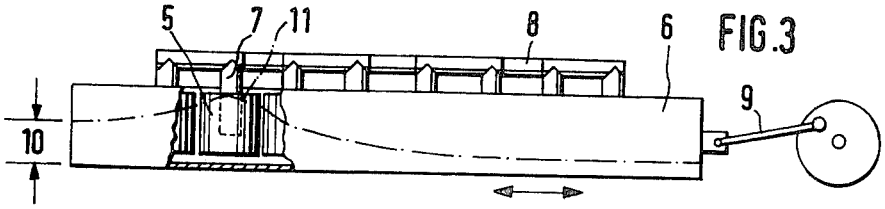
FIG. 3 is a side view in partial section of an apparatus according to the invention.
Figure 4:
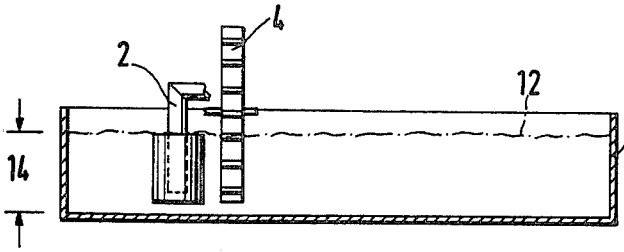
FIG. 4 shows the water level height in the tank and/or the depth of dipping of the freezer fingers in the known paddle system.
Figure 5:
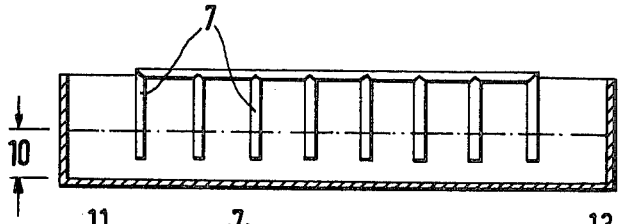
FIG. 5 shows the water level height and/or the dipping depth of the freezing fingers while the tank is at rest according to the invention.

For comparison, the water level 14 with the known apparatus (FIG. 4) is substantially identical with the level of water circulating around the freezing fingers during operation. The top surface 12 of the water is rough as a result of the rotating paddles.

Figure 6:
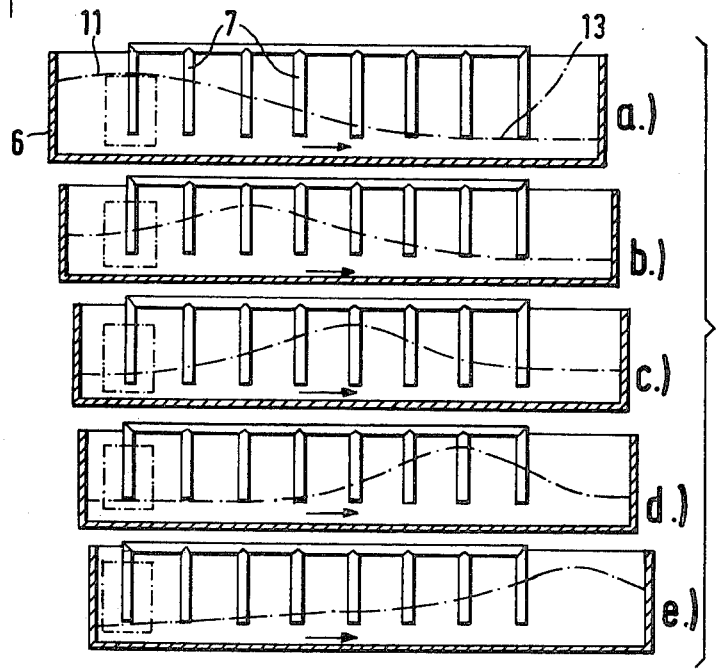

In FIG. 6, by way of comparison, the continuous wave peak 11 and the related wave trough 13 produced through the horizontal to and fro movement of the tank 6, are shown. The vertical and horizontal circulation about the freezer fingers 7 is made evident here.

FIG. 7 shows an eccentric cam 15 which moves the tank 6 tiltingly about a pivot point 16. Through the rhythmic movement, there results a wall to wall continuous water wave and an approximately horizontal movement of water analogous to FIG. 6.

By each change in stroke directions the direction of the water flow and the direction of the progressing water wave changes so that a rhythmic to and fro wall of the wave and of the water results.

I claim:

1. A process for the manufacture of clear ice bodies of the type wherein freezing fingers are dipped in a tank which is opened at the top and contains water and the water is caused to flow around the fingers to remove air and salts precipitated as a result of the freezing from the ice surface on the fingers, the improvement comprising producing the flow of water by a controlled rhythmic rise and fall movement of the water level in the form of continuous water waves.

2. A process as claimed in claim 1 wherein the continuous waves take the form of tank wall to tank wall, to and fro water waves.

3. A process as claimed in claim 1 wherein the rise and fall movement of the water level results from displacement waves emanating from vertical movement of the freezing fingers with respect to the tank.

4. A process as claimed in claim 1 wherein a vertical wave movement is superimposed on a horizontal water movement.

5. A process as claimed in claim 1 wherein the waves are produced by tank movements with respect to the fingers and wherein the number of strokes per minute of tank movement, and the extent of the strokes are predetermined so as to produce a tank wall to tank wall to and fro continuous wave.

6. The process as claimed in claim 1 wherein the depth of water in the tank is adjusted so that the upper portions of the freezing fingers are covered only during the crest of the waves.

7. Apparatus for the manufacture of clear ice bodies of the type where freezing fingers are dipped in a tank which is open at the top and contains water and the water is caused to flow around the fingers to remove air and salts precipitated as a result of freezing from the ice surface on the fingers, comprising means for holding the freezing fingers in a stationary position during the freezing step, said tank being mounted for movement, and means for moving the tank with respect to the fingers during the freezing step to produce a controlled rhythmic rise and fall movement of water level in the form of continuous waves around the fingers.

8. The apparatus as claimed in claim 7 wherein said tank is mounted for movement in a horizontal direction and the means for moving the tank comprises a crank gear.

9. The apparatus as claimed in claim 7 wherein the means for producing the flow of water around the fingers comprises lifting and lowering means for the tank.

10. The apparatus as claimed in claim 7 wherein the means for producing flow of water in the tank comprises means for mounting the tank for pivotal movement about a central vertical axis and means to pivot the tank.

* * * * *